US007131896B2

(12) United States Patent
Faas et al.

(10) Patent No.: US 7,131,896 B2
(45) Date of Patent: Nov. 7, 2006

(54) DEVICE FOR GRINDING OF CLOTHING IN A TEXTILE MACHINE

(75) Inventors: Jürg Faas, Andelfingen (CH); Beat Näf, Jona (CH); Christian Sauter, Flurlingen (CH); Yücel Yildirim, Winterthur (CH); Roland Styner, Winterthur (CH); Roland Bischof, Zürich (CH); Christian Müller, Wallenwil (CH)

(73) Assignee: Maschinenfabrik Rieter AG, Winterthur (CH)

( * ) Notice: Subject to any disclaimer, the term of this patent is extended or adjusted under 35 U.S.C. 154(b) by 148 days.

(21) Appl. No.: 11/042,279

(22) Filed: Jan. 25, 2005

(65) Prior Publication Data

US 2005/0124268 A1 Jun. 9, 2005

Related U.S. Application Data

(62) Division of application No. 09/786,731, filed as application No. PCT/CH99/00422 on Sep. 8, 1999.

(30) Foreign Application Priority Data

Sep. 9, 1998 (CH) ..... 1840/98
Feb. 26, 1999 (DE) ..... 199 08 708

(51) Int. Cl.
*B24B 19/18* (2006.01)

(52) U.S. Cl. ..... 451/184; 451/416

(58) Field of Classification Search ..... 451/416, 451/417, 184, 57, 58

See application file for complete search history.

(56) References Cited

U.S. PATENT DOCUMENTS

| | | | | |
|---|---|---|---|---|
| 424,763 | A | 4/1890 | Cunningham | |
| 429,044 | A | 5/1890 | Middleton et al. | |
| 519,771 | A * | 5/1894 | Prest | 451/417 |
| 532,331 | A * | 1/1895 | Mills | 451/417 |
| 534,721 | A * | 2/1895 | McDermott | 451/417 |
| 575,689 | A | 1/1897 | Brown | |
| 598,015 | A | 1/1898 | Schweinefleish | |
| 1,886,089 | A | 11/1932 | Dronsfield | |
| 2,132,240 | A * | 10/1938 | Hope | 451/417 |
| 2,849,844 | A | 9/1958 | Snape, Jr. | |
| 3,528,205 | A * | 9/1970 | Roberts | 451/417 |
| 4,985,966 | A | 1/1991 | Nitschke et al. | |
| 5,355,560 | A | 10/1994 | Fritzsche et al. | |
| 5,542,154 | A | 8/1996 | Demuth et al. | |
| 5,625,924 | A | 5/1997 | Sauter et al. | |
| 5,894,636 | A | 4/1999 | Sauter et al. | |
| 5,956,811 | A | 9/1999 | Cahannes et al. | |
| 6,129,614 | A | 10/2000 | Faas et al. | |

FOREIGN PATENT DOCUMENTS

| | | |
|---|---|---|
| EP | 0800895 | 10/1997 |
| GB | 0004320 | 9/1882 |
| GB | 870424 | 6/1961 |
| JP | 3295169 A | 12/1988 |
| WO | WO 9916579 | 9/1998 |

OTHER PUBLICATIONS

PCT Search Report dated Dec. 3, 1999.
U.S. Appl. No. 09/509,756, filed May 19, 2000.

* cited by examiner

*Primary Examiner*—Robert A. Rose
(74) *Attorney, Agent, or Firm*—Dority & Manning

(57) ABSTRACT

A grinding device for the flats of a card comprises elastically bendable elements which enter between the clothing points, brush over the side flanks of the points and thereby grind the points. Additional grinding elements are provided in order to treat the front sides of the clothing points. The ground-off material may be removed by a suction device.

9 Claims, 12 Drawing Sheets

DEVICE FOR GRINDING OF CLOTHING IN A TEXTILE MACHINE

RELATED APPLICATION

The present application is a Divisional Application of U.S. application Ser. No. 09/786,731, filed May 31, 2002.

FIELD OF THE INVENTION

The invention relates to the grinding (or "sharpening") of clothings, in particular, but not exclusively, clothings of flats of a revolving flat card. The invention is suitable for the installation of a grinding device (sharpening device) in the carding machine, but it is not limited thereto and could therefore be applied in a device which is attached to the carding machine when required and is carried from carding machine to carding machine. The invention is designed in such a way that the device can be inserted when the carding machine is in operation. This also does not constitute any limitation since the invention could also be used in a device which only works when the carding machine is at a standstill (not producing).

The invention relates in particular to a sharpening or grinding device for a clothing consisting of clothing elements, in particular clothing teeth or wires, with a plurality of individual flank grinding elements, between which the clothing elements to be ground penetrate for the grinding of the lateral surfaces of the clothing elements. Moreover, the invention relates to a sharpening and grinding device for a clothing consisting of clothing elements, in particular clothing teeth or wires, with a plurality of individual bristle-like grinding elements. The invention further relates to a device for advancing a clothing with clothing elements which is arranged on a clothing carrier towards a grinding and sharpening device with a plurality of individual grinding elements.

Clothings are arranged in particular, but not exclusively, on flats of a revolving flat card.

The invention is suitable for the installation of a grinding device (sharpening device) in the carding machine, but it is not limited thereto. It could therefore be applied in a device which is attached to a carding machine when required and is carried from carding machine to carding machine. The invention is designed in such a way that the device can be inserted when the carding machine is in operation. This also does not constitute any limitation since the invention could also be used in a device which only works when the carding machine is at a standstill (not producing).

STATE OF THE ART

A former application, EP-A-800 895 (corresponding to U.S. Pat. No. 6,129,614), describes a sharpening or grinding device which can be used for grinding flat clothings. A further earlier application PCT/IB98/01471 (WO/99/16579) improves the concept according to EP-A-800 895.

According to EP-A-800 895, a grinding device comprises a plurality of individual grinding elements which penetrate between the tips of the clothing to be ground, sweep over the head sections of the tips and can grind the same during this process. The grinding elements are preferably elastically flexible.

The grinding elements can be arranged in such a way that during the operation they are distributed over the working width of the carding machine. For this purpose they can be carried by an oblong carrier, e.g. in such a way that each grinding element is attached to one end of the carrier and projects transversally to the carrier from its fastening point. The carrier can be mounted in operation on the card frame by means of a fixing device at an approximately predetermined relationship to the revolving flat unit, e.g. in such a way that the flats are ground during the "return run".

The grinding elements, the carrier and the fixing device can jointly form an apparatus which is built into the carding machine, e.g. in such a way that the apparatus is put into operation with the carding machine per se. For this purpose the carding machine can comprise a drive or a control unit for the grinding apparatus. The apparatus can also be arranged in such a way that it can be attached to the carding machine. It could comprise its own drive or own control unit for example.

According to a first aspect of the invention according to WO99/16579 a grinding device for a card flat is characterized further in that it is provided with a means for removing released grinding particles (preferably with a suction device).

According to a second aspect of the invention according to WO99/16579, a grinding device according to EP-A-800 895 is further characterized in that it is arranged with respect to a clothing carrier (e.g. a revolving flat unit) in such a way that a substantially predetermined immersion depth of the grinding elements into the clothing is obtained.

According to a third aspect of the invention according to WO99/16579, a grinding device according to EP-A-800 895 is further characterized in that it is not put into operation continuously, but discontinuously in a controlled manner (intermittently). The expected (effective) application period can represent a total of less than 5% (optionally less than 1%) of the service life of the carding machine.

According to a fourth aspect of the invention according to WO99/16579, a grinding machine for a clothing is provided which comprises elastically bendable elements, with said elements sweeping over the face sides of clothing elements and being thus able to grind or sharpen the same. This aspect was designed especially in WO99/16579 for the sharpening of saw-tooth clothings.

The disadvantageous aspect of the state of the art is that the path of the advancement of the grinding device to the clothings needs to be determined. Following wear and tear of the grinding means or the clothings it is necessary to check the path of advancement during each new grinding process and it is optionally necessary to newly set it again. This is a laborious process and can also be susceptible to errors.

SUMMARY OF THE INVENTION

Objects and advantages of the invention will be set forth in part in the following description, or may be obvious from the description, or may be learned through practice of the invention.

The terms grinding device and sharpening device shall mean the same in the description below.

The present invention is designed for the grinding or sharpening of clothing elements in the form of hooks, as are usually found in the clothings of revolving flats of a revolving flat card.

The invention provides a grinding device for sharpening the tips of hooks which is provided with bristles which come to rest against the ends of the hooks and grind the hooks during a relative movement. In contrast to bristles according to EP-A-800 895, these bristles do not press between the hooks (i.e. they do not influence the "lateral grinding"), but instead ensure the formation of an edge at the tip of the hook. Preferably, the grinding device is provided both with penetrating bristles (according to EP-A-800 895) as well as contacting bristles (according to the present invention).

The present invention can be combined collectively or individually with the first to third aspect of the invention according to WO99/16579, with the problems linked to the advancement of a clothing to a grinding device actually being reduced by the present invention insofar as the advancement is preferably performed until contact with a predetermined pressing force or is replaced by the advancement of the device to the clothing.

In according with the invention, face grinding elements are provided in the generic sharpening or grinding device in addition to the flank grinding elements. They are designed for working the face sides of the clothing elements. This arrangement in accordance with the invention of further grinding elements ensures that not only the flanks of the clothing elements are repaired, as is the case up until now, but that in addition the face sides, i.e. the edges of the upper side and the tips of the clothing elements, can be re-worked precisely according to shape. Said re-working precisely according to shape substantially produces like-new clothing elements which are ideally suited in the application in a carding machine for example to perform the carding of the fibers in an optimal manner. Rounded edges or blunt tips of the clothing elements are effectively prevented by the present invention. The invention allows producing straight edges and sharp tips. Best carding results are thus obtained, even with used clothing elements.

Preferably, the flank grinding elements and the face grinding elements are arranged on a carrier. As a result, a particularly simple constructional design of the present invention is created. The flank and face grinding elements can be evenly distributed over the length of the clothing, which can be arranged on a flat bar for example. Zones can be equipped with flank grinding elements and other zones with face grinding elements. The flank and face grinding elements can also be arranged substantially simultaneously in the same zones. The respective best arrangement is determined by the shape of the clothing elements and the shape of the carrier as well as the easiest possible way of equipping the carrier with the respective grinding elements.

A particularly preferable embodiment of the invention provides the carrier as a rotatable roller. A high cutting speed during the grinding of the clothing elements is enabled at a respective speed of the roller. The constructional arrangement of such a sharpening and grinding element is relatively simple and cost-effective.

If starting from the carrier, the face grinding elements are provided with a lower height than the flank grinding elements, both the side as well as the face of the clothing elements are to be sharpened and ground in one pass. In this process, the carrier only needs to have a defined distance from the clothing in order to enable the same to grind both the sides as well as the face to the desired extent.

The present invention will be used most frequently in a clothing in a revolving flat unit of a carding machine. The revolving flats are guided past the grinding device which is provided with a stationary arrangement, as a result of which the clothing elements are ground. In order to obtain reliable and precise grinding it may be advantageous to move the revolving flat past the grinding device several times until the grinding process is ended. In the preferred arrangement, however, each flat bar is only sharpened once per grinding cycle. It is understood that the invention can naturally also be used for the grinding and sharpening of stationary flats or other clothings.

Bristles have proven to be particularly advantageous for the use as flank and/or as face grinding elements. The bristles are flexible and optimally adapt to the respective shape of the clothing elements. The grinding of the clothing elements is produced by a respective surface of the bristles. As a result of different lengths of the bristles, the flank or the face of the clothing elements is ground. The mentioned surface can be formed by a composition of plastic and grinding means.

If the flank and/or face grinding elements form a brush which rests on the clothing without the said grinding elements penetrating substantially between the clothing tips, it is possible to grind only the clothing tips in a respective way and not to weaken the basis of the clothing elements.

In an alternative embodiment the face grinding elements in particular are grindstones. This enables a dimensionally highly precise grinding of the clothing elements concerning their height. Similarly, highly precise dimensional grinding of the clothing tips can be achieved with grindstones. Depending on the respective application, they can offer particular advantages in the processing of fibers.

The face grinding elements can be provided with a coarser graining than the flank grinding elements. This ensures a different grinding effect on the clothing elements as well as a different service life of the elements. A respective arrangement of the grinding elements with respect to their graining ensures that the service life of both types of grinding elements is approximately the same despite different stresses, so that also the advancement of the clothing to the grinding element causes the same advancement of the flank grinding elements and the face grinding elements.

The device further comprises a means for removing particles abraded by the grinding, thus reliably preventing any soiling of the device. By removing particles abraded by grinding, a disturbance-free operation is ensured, as well as the reliable prevention of any soiling of the fiber material. Preferably, the means for removing the abraded particles is a pneumatic suction means which extends over the working width of the clothing and is arranged with respect to the grinding position in such a way that it can produce an air flow through or past the grinding position. A complete suction of the grinding position and the clothing or clothing carrier is thus produced, so that during the engagement of the clothing in the fiber material, substantially no abrasive dust will adhere and lead to any soiling or defects in the fiber material.

The apparatus in accordance with the invention is preferably arranged on means in order to fasten the device to the card frame and to grind and sharpen the respective flat clothings there. This ensures that the device is provided with a predefined distance from the flat clothing, thus also ensuring precise grinding.

If the device in accordance with the invention is provided with a control unit which puts the device intermittently into operation, the grinding process must be started at predetermined times. A more or less frequent grinding of the clothing elements can be performed depending on the fiber material, soiling and wear and tear of the clothing elements. It will be necessary to find a compromise between the permissible wear and tear of the clothing elements and the work result of the clothing elements. The more the grinding elements are worn off, the worse will be the expected result of the work. For achieving the best possible working results it will therefore be necessary to provide more frequent grinding, whereas in the case of the most economical use it will be necessary to perform grinding less frequently.

The device in accordance with the invention can be used both stationary in the machine as well as a portable service device for clothings of different machines. The service device is placed merely for grinding on a machine in non-stationary operation and removed again after the grinding process. It can therefore be used at other machines during periods when grinding is not being performed at a given machine.

A device for advancing a clothing with clothing elements may be provided on a clothing carrier towards a sharpening or grinding device such as a sharpening or grinding device of the kind mentioned above and a plurality of individual grinding elements is arranged in such a way that a means is provided which brings a force to bear between clothing and grinding device, so that the clothing and the grinding device are pressed against one another, and causes a predetermined immersion depth of the clothing elements into the grinding device. As a result, an even pressing of the clothing against the grinding device can be ensured. This leads to a balanced state between the clothing and the grinding device which, depending on the chosen force, causes the predetermined immersion depth of the clothing elements. A pressing of the clothing against the grinding elements is performed, thus enabling the purposeful grinding of the clothing elements. The present device in accordance with the invention enables a grinding of the clothing elements which is particularly precise relating to shape and dimension. As a result of the cooperation of the sharpening and grinding device, a particularly advantageous device for grinding and sharpening is created. The aforementioned sharpening and grinding device can be used both with or without the advancing device in accordance with the invention. By combining the two devices, however, a particularly advantageous arrangement of the invention is achieved.

It has been noticed that the force to be exerted on the clothing depends on the resisting force of the grinding elements of the grinding device. The higher the resistance of the grinding elements, the higher the force with which the clothing needs to be pressed against the grinding device when the same path of advancement is to be achieved. In order to produce different advancements of the clothing elements towards or into the grinding elements, it is advantageous if the force with which the clothing is pressed in the direction towards the grinding device is adjustable. In this way it is possible to change the penetration depth of the clothing into the grinding elements and the erosion during the grinding can be adjusted.

Preferably, the force is set in different grinding elements in such a way that the clothing elements will just about contact the shorter grinding elements. It is ensured in this way that substantially all grinding elements are in engagement with the clothing elements and thus an optimal success can be achieved in the grinding.

A particularly advantageous factor contributing to the success of the grinding and the economical design of the device is that the force acts via supporting surfaces for the clothing carrier, which is arranged during the grinding process on the supporting surfaces, on the clothing carrier and the clothing device. Surface areas are not created which cooperate with the counter-surfaces on the clothing carrier and thus ensure a precise positioning of the clothing carrier and clothing elements with respect to the grinding device. The force can be introduced in a defined manner on the clothing carrier.

The force can be applied via springs or fluid cylinders on the clothing. They can be flat coil springs, leaf springs or rubber springs. Pneumatic or hydraulic cylinders can be used in particular as fluid cylinders. The force can also be produced by the weight of the device, optionally in combination with a counterweight.

Preferably, the supporting surfaces are provided with a movable arrangement in the direction towards the grinding device. As a result, the supporting surfaces are brought together with the clothing into contact with the grinding device when required. As a result of the movable arrangement, the clothing is enabled to yield with respect to the grinding device in the event of excessive force application, so that the clothing and the grinding device are always in an equilibrium of forces. In contrast to the state of the art, in which there is merely a path advancement, there is in this case a honing in and an even application of the grinding device on the clothing elements.

When the clothing elements are not ground it is advantageous that the supporting surfaces can be brought out of engagement with the clothing carrier. In this way the revolving flat in a revolving flat unit in particular is moved past the grinding device without being pressed by the supporting surfaces in the direction towards the grinding device. As a result of the engagement and disengagement of the supporting surfaces with the clothing carrier it is thus also possible to realize the intermittent advancement of the clothing to the grinding device in a particularly advantageous manner.

In order to facilitate the run-up of the clothing carrier on to the supporting surfaces in moved clothings in particular, i.e. in a revolving flat unit, it is advantageous when ramps are provided on the supporting surfaces. The clothing carriers are thus gradually brought to the desired distance and action of force with the grinding device.

It is advantageous when the grinding and sharpening device can be used portably for clothings of different machines. In particular, as a result of the relatively short use of the device it is economically possible to provide a single device for several machines.

Embodiments of the invention are explained below by reference to examples shown in the drawings, wherein:

DETAILED DESCRIPTION

Figure 1:
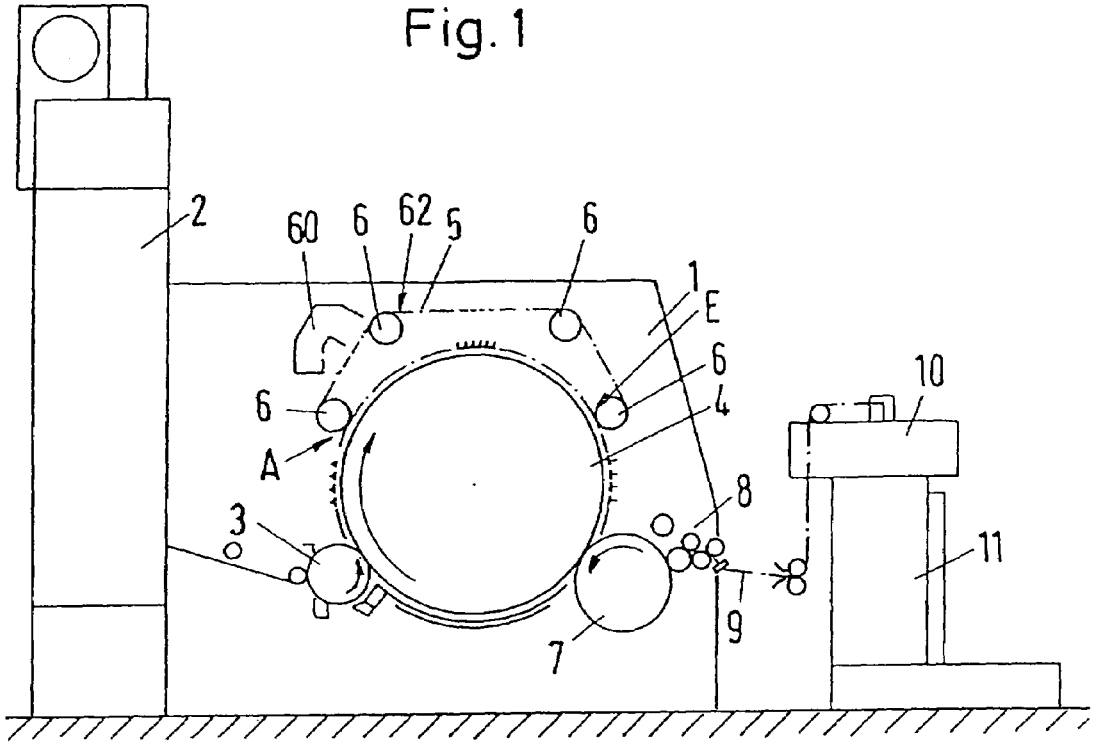
FIG. 1 shows a copy of FIG. 1 of EP-1-787 841.
Figure 2:
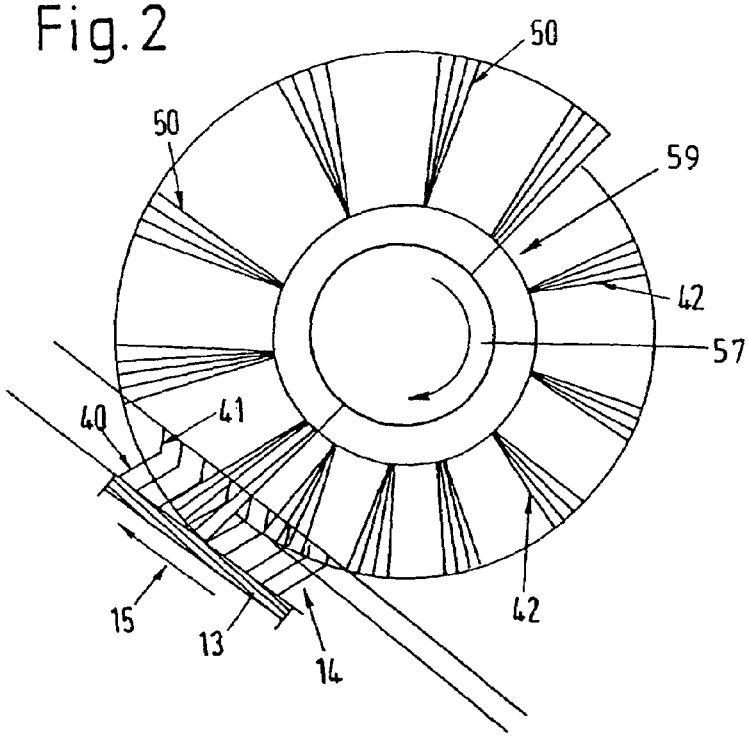
FIG. 2 shows a first embodiment of the state of the art according to EP-A-800 895.

FIG. 1 schematically shows a known revolving flat card 1, e.g. the carding machine C50 of Maschinefabrik Rieter. The fiber material is supplied in the form of opened and cleaned flocks into the filling box 2, received by a licker-in or taker-in 3 as a lap feed, transferred to a swift or cylinder 4, and cleaned and opened by a set of revolving flats. Fibers from the nonwoven disposed on cylinder 4 are received by a doffer 7 and formed into a card sliver 9 in the delivery section 8. Said card sliver 9 is then deposited by a coiler 10 in a transport can 11. The carding machine is provided with a "main suction means" with which waste can be removed. Such a suction means is not shown specifically in FIG. 1, but it is certainly known to the man skilled in the art. An example for such a suction means is known in EP-A-340 458. The set of revolving flats comprises revolving flat bars which are not shown individually in FIG. 1, but are indicated in FIG. 2 with reference numeral 13. Each rod 13 is provided with a clothing 14.

The flats 13 are fastened to a chain or a belt 5 (e.g. according to EP-A-753 610). As a result, they are moved along a closed "flat path" (via deflection pulleys 6) in synchronicity or in opposite direction to the direction of rotation of the cylinder 4, with the carding work being performed on a "pre-run section" (from the inlet position E to an outlet position A) and the flats are cleaned in the "after-run section" on a cleaning position 60. The cleaning apparatus has been explained in closer detail in EP-A-800 894. Thereafter, the flats 13 according to EP-A-800 895 could be ground at position 62 for example.

FIG. 2 shows an embodiment according to EP-A-800 895, with the grinding position "coinciding" in this embodiment with the cleaning position. This embodiment comprises a "brush" with a sleeve 59 (FIG. 2), grinding elements 42 and cleaning bristles 50 which are carried by the sleeve and extend in the radial direction away from sleeve 59. The sleeve 59 is preferably formed of two "half shells" which in the installed state fit snugly against a drive shaft 57. The brush is provided as a part of the flat cleaning apparatus 60. FIG. 2 also shows a flat bar 13 (including the clothing 14). The direction of movement of the flat bar 13 as well as the direction of rotation of the sleeve 59 are indicated by arrows.

As is common practice in the clothing of card flats, the clothing 14 is arranged as a flexible or semi-rigid clothing, with the individual clothing elements 40 being formed of wire (flattened or round wire), each with a so-called knee 41. The bristles 50 immerse up to the base of the clothing 14, i.e. up to the surface of rod 13, whereof the wires 40 project in order to thoroughly clean the clothing. However, only half the circumference of the sleeve 59 is equipped with bristles 50. The other half carries the aforementioned grinding elements 42.

Figure 3:
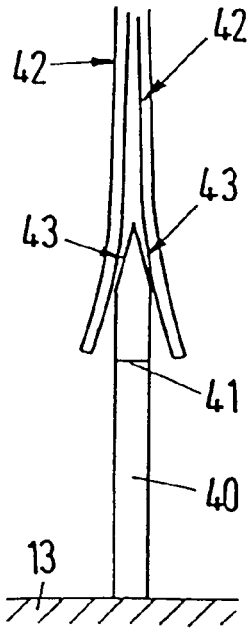
FIG. 3 shows a schematic representation of a single wire piece, as seen from the front, in order to illustrate the grinding effect according to EP-A-800 895.

The grinding elements 42 are similar in this embodiment to the bristles 50 in such a way that they are formed as oblong, elastically bendable elements which project approximately radially from the jacket surface of the sleeve 59. The grinding elements 42 are also more flexible than the wires 40, so that in the case of contact of such an element with a wire piece during a relative movement of the element and the wire, the grinding element 41 must yield. The elements 42 are considerably shorter than the bristles 50, so that they only reach the "head sections" of the clothing wires 40 (above the respective knee 41). The speed of the free end zone of each element 42 is nevertheless higher than the speed of the clothing wires 40 in the direction of movement 15. When the grinding elements 42 are moved past the clothing elements 40, they penetrate the clothing, with their free end zones being deflected on either side of the head section of the wires (FIG. 3).

Figure 4:
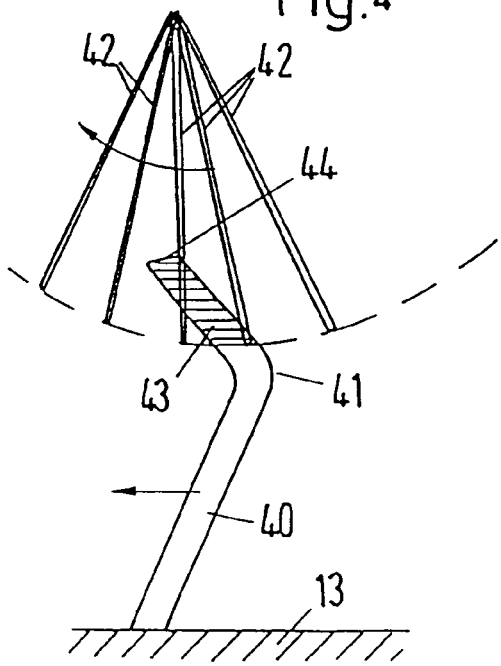
FIG. 4 shows a schematic representation of the same wire piece as seen from the side.

The head section of each wire element is provided with a lateral grinding, i.e. the side areas 43 (FIGS. 3 and 4) converge outwardly in the radial direction in order to form an end edge 44. During each passage of the grinding elements 42 past the surface 43 a polishing and grinding of the side surface 43 occurs. The aggressiveness of the polishing and grinding effect depends on the arrangement of the grinding elements and the speed of the relative movement. The optimal effect for a given wire type can be determined empirically.

The solution according to FIG. 2 has certain advantages in retrofitting existing carding machines which are equipped with a cleaning brush (only provided with bristles 50). The "infrastruction" (i.e. the carrier in the form of a sleeve 59, its fixing device in the form of shaft 57, its bearing and the associate drive) is already present. The flat cleaning is permanently in operation (as long as the carding machine is running); the flat wires are accordingly ground "continuously" and certain disadvantages must be taken into account:

- The cleaning effect decreases because half the cleaning bristles 50 "are missing" (because they were replaced by grinding elements);
- It is not possible to optimize both the cleaning as well as the grinding effect by adjusting the speed of shaft 57 (FIG. 2);
- It is not possible to "switch off" the grinding alone, e.g. in order to enable periodic grinding (according to a controlled stop-and-go method). Such a method has been described in EP-A-565 486 for example.

It has therefore proven to be advantageous to provide a separate infrastructure in the carding machine for grinding, in particular a separate fixing device for the carrier (on which the grinding elements 42 are attached) and a separate controllable drive. In this way it is possible to achieve a relative speed of the grinding elements with respect to the wires of more than 15 m/sec. (e.g. approx. 20 m/sec.). Such a relative speed is not optimal for a cleaning brush. The grinding position would thus be separated from the cleaning position and is preferably behind the cleaning position as seen in the direction of movement 15 (FIG. 2).

Figure 5:
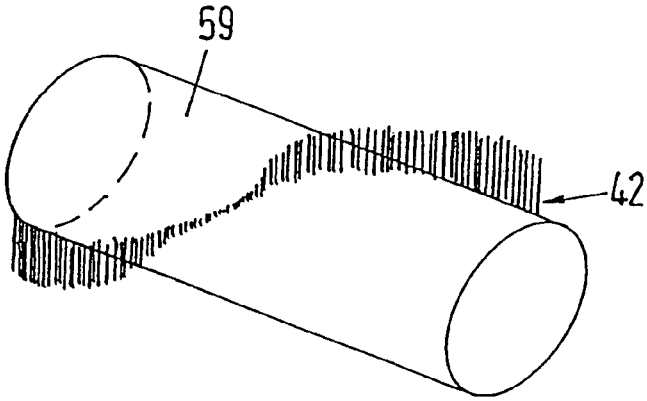
FIG. 5 shows a schematic representation of a variant of the embodiment according to FIG. 2, with FIG. 5A showing a detail of said embodiment.

The variant according to FIG. 5 comprises a helical arrangement of grinding elements 42 along a cylindrical carrier. Each element is formed as a bristle 45 (see the detail in particular—FIG. 5A). The bristles 45 are shorter than the bristles 50 of the embodiment according to FIG. 2 and at least the free end zone of each bristle 45 is provided with an abrasive in order to form a grinding zone (grinding body). The entire bristle can also be interspersed with an abrasive. The abrasive consists for example of solid particles 46 (abrasive grain, diamond grain or the like) which are fastened to the bristle 45 by means of glue or a bonding agent or are embedded in a matrix. The helical row of elements 42 extends over the entire length of the carrier and therefore over the entire working width. On the invisible side of the sleeve 59 it is possible to provide a second row of grinding elements mirror-inverted to the first row.

The description assumed until now that the grinding apparatus should be built into the carding machine. The invention according to EP-A-800 895 is not limited to this, however. The carding machine could be provided with mere fastening points for example where a fixing device for the grinding apparatus can be attached. The apparatus per se could then be carried from card to card and could be mounted and put into operation on a certain card when required. Such an apparatus could be provided with its own drive to rotate the carrier carrying the grinding elements or could merely be provided with a coupling in order to enable a temporary connection with the drive of the machine.

The preferred solution according to EP-A-800 895 comprises a grinding apparatus with its own "infrastructure" (carrier, drive, etc.) and with grinding elements according to FIG. 5, with the carrier 59 having been preferably "fully equipped" (instead of individual helical rows of grinding elements), which means that it should be equipped with grinding elements over the entire circumference.

Figure 5A:
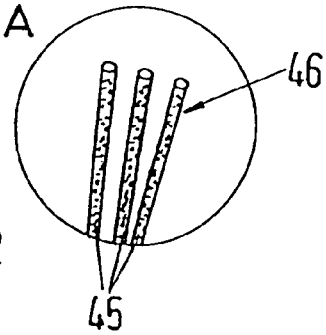
Figure 6:
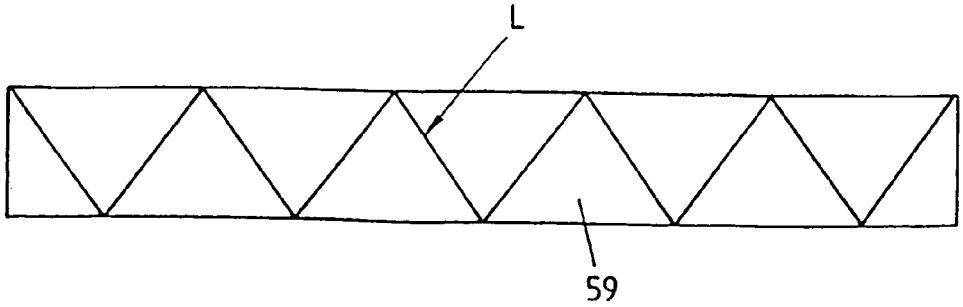
FIG. 6 shows a schematic representation of a possible arrangement of the grinding bristles on their carrier.

For certain applications it has proven to be undesirable to realize the brush as a "fully equipped" carrier. Grinding elements are available on the market which are too aggressive in their effect in the fully equipped design. An alternative arrangement is therefore shown in FIG. 6 and consists of a zig-zag-shaped row of the groups of brushes along each half shell. The individual bristles are shown in FIG. 5A. Each consists of a filament-like nylon substrate, penetrated with silicon carbide. Following the gradual attrition of the bristle, new grinding particles are uncovered. The number of the clothing tips which are ground simultaneously is obtained from the number of the "bristle lines" L. This can be chosen depending on the output of the drive.

Figure 7:
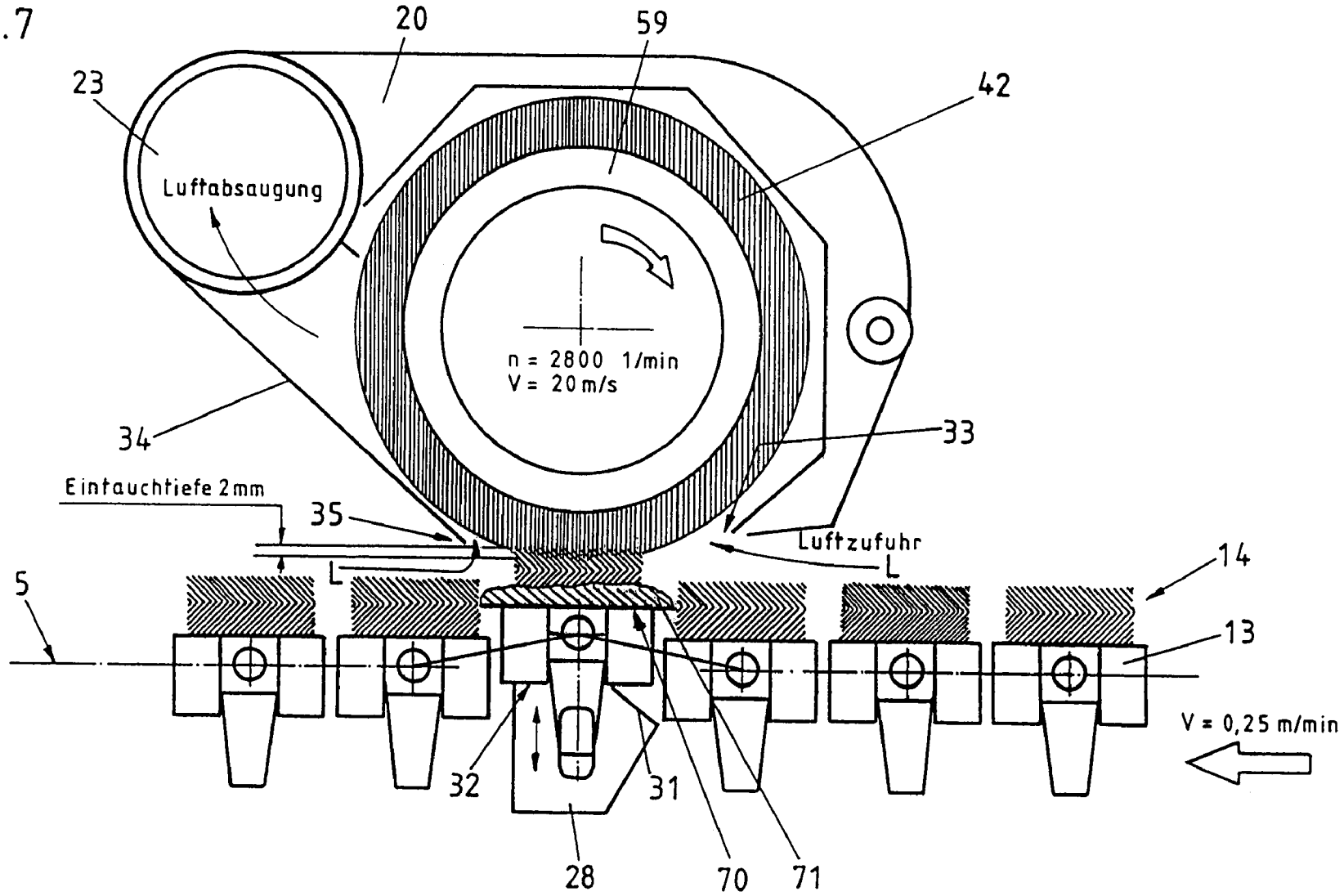
FIG. 7 shows a schematic side view in the cross section of a preferred device according to WO99/16579.

FIG. 7 shows two further modifications of the arrangement according to EP-A-800 895, namely:

A suction means in order to remove abraded particles, and

A flat advancing apparatus which can advance the flat bars one by one for grinding the respective clothing by lifting from the flat path to a grinding position of the brush.

Figure 9:
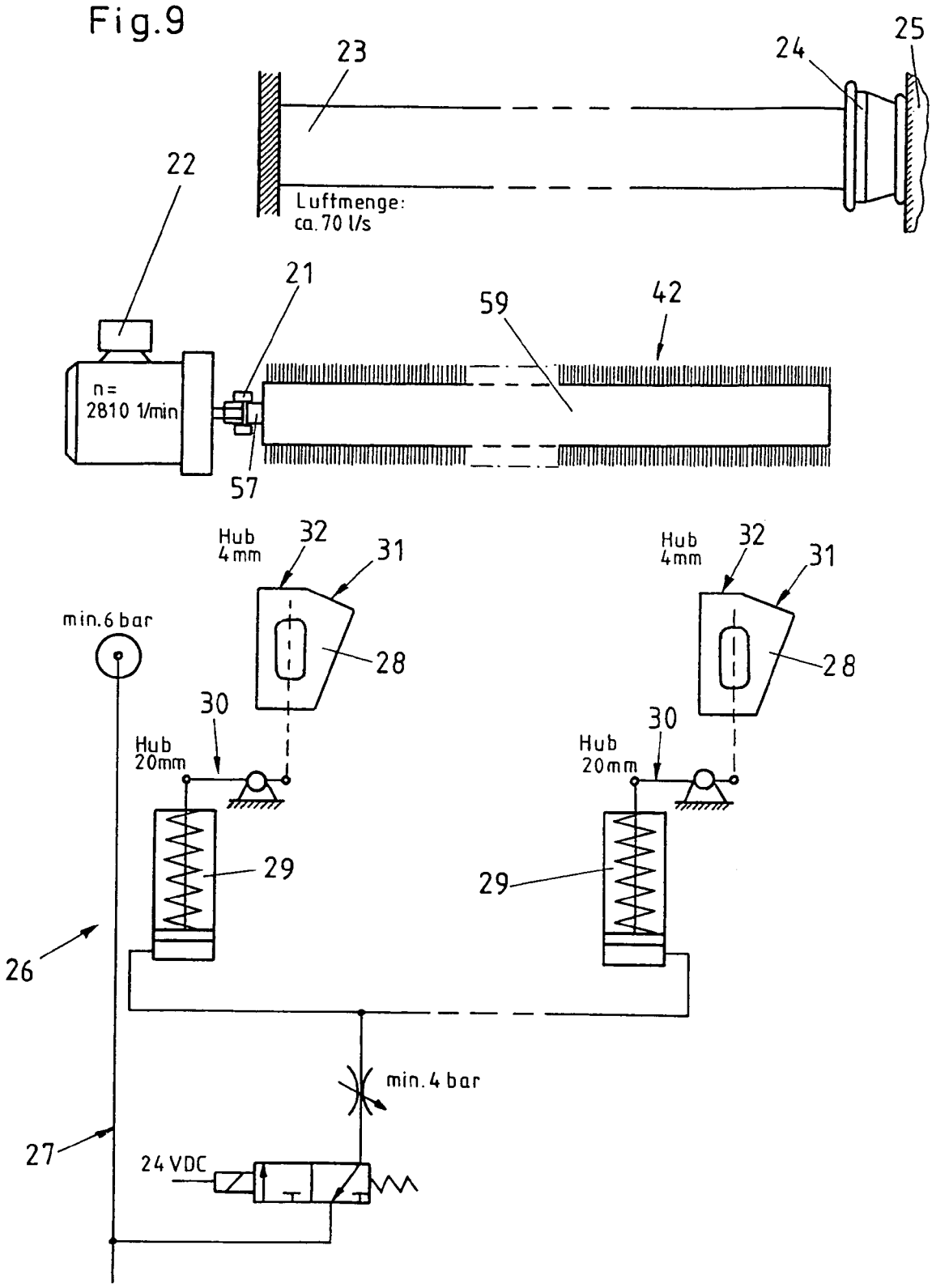
FIG. 9 shows a diagram of a flat advancing device of the device according to FIG. 8.

The sharpening or grinding device according to FIG. 7 therefore comprises the following elements:

A housing 20 which is provided for mounting on a card frame at a predetermined position outside of the path of the flat and (downstream) in the running direction of the flat after the cleaning position 60 (FIG. 1);

The brush with the carrier 59 (preferably formed of half shells), grinding bristles 42 and a respective bearing or fixing (not shown) in housing 20;

A controllable brush drive 22 (FIG. 9) which is fastened to housing 20 and is connected to shaft 57 by means of a coupling 21;

An air suction conduit 23 which extends over the working width of the clothing 14 and can be connected at one end with the main suction device 25 of the carding machine by means of a coupling 24 (FIG. 9);

A pneumatically actuable lifting apparatus 26 (FIG. 9) which is arranged on the inner side of the path of the flat and is disposed opposite of the housing 20 of the grinding device.

The lifting apparatus 26 comprises two lever arms 28 which are arranged in the vicinity of a card side shield each (not shown). These elements can be moved perpendicularly up and down by means of a pneumatic cylinder 29 and a lever 30 each between a lower standby or idle position and a working position. Each lifting element 28 is provided with a ramp 31 and a horizontal supporting surface 32.

The carding machine per se comprises a compressed air supply 27 for the lifting apparatus 26 and a control unit (not shown) for the brush drive 22.

Figure 8:
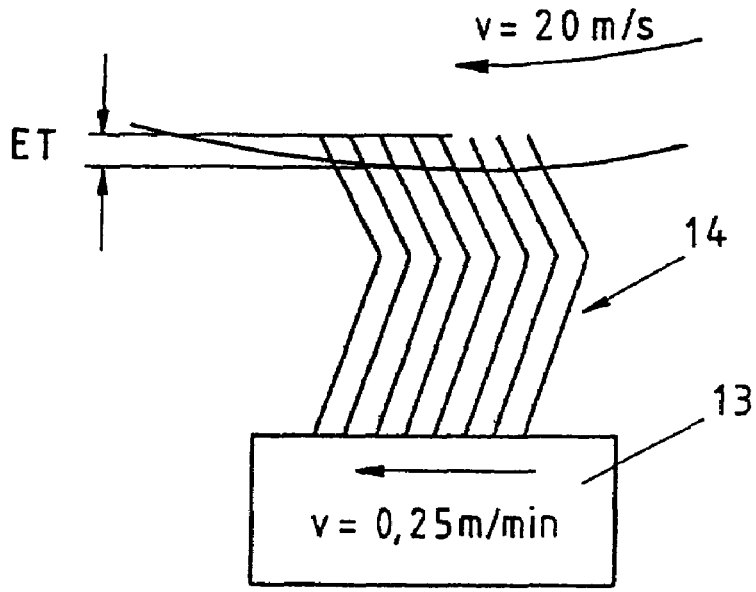
FIG. 8 shows a detail of FIG. 7.

The grinding device according to FIGS. 7 to 9 works as follows:

Once the carding machine has been put into operation with a new flat clothing, the grinding device does not work, meaning that the carding machine supplies neither the brush nor the lifting apparatus with power. The flats 13 travel according to their "normal path" without coming into contact with the lifting elements 28 of the lifting apparatus 26 because these elements rest currently in their lower (standby) positions. The position of housing 20 is chosen in such a way with respect to the normal path of the flats that there is also no contact between the grinding bristles 42 and the clothing tips. The air suction conduit 23 is separated from the main suction device 25 of the carding machine by means of a flap (not shown), so that no air flow is produced in the suction conduit 23 by the housing 20.

At a suitable time (which will be explained below in closer detail) the grinding apparatus (including the lifting apparatus and the suction means) is put into operation. For this purpose the brush is made to rotate in the direction of the arrow (FIG. 7), the air suction conduit 23 is connected with the main suction device 25 of the carding machine and the pneumatic cylinders 29 are actuated, so that the lifting elements 28 can be lifted to their working positions. As is shown schematically in FIG. 7, the flats 13 can no longer move past the lifting elements 28 without touching the ramps 31. When the flats 13 are pulled forward by the chains or belts 5, they must first run up the ramps 31 one by one, then move parallel to the normal path over the supporting surface 32 and thereafter return to the normal path. When the lifting elements 28 are in their raised (working positions), the supporting surface 32 defines a "grinding position" in which the wire tips of the clothing 14 lie within the cylindrical jacket surface of the grinding bristles 42. The stroke of the lifting movement is chosen in such a way that the grinding bristles 42 (while a flat 13 is advanced towards the brush of the lifting apparatus 26) penetrate the clothing up to a predetermined "immersion depth" ET (FIG. 8) and grinds the clothing tips (according to the earlier invention). For a semi-rigid or flexible clothing it has proven to be advisable to provide a maximum immersion depth ET of approx. 2 mm (measured from the clothing tip, cf. FIG. 8), whereby this parameter can be optimized depending on the type of clothing and can be chosen differently for an all-steel clothing.

The lifting apparatus 26 remains in this working state until each flat 13 has been ground "x times", with "x" being any rational number, preferably in the range of 1 to 5. The lifting elements 28 are lowered again thereafter. A control unit suitable for this purpose will be explained below. The grinding of all flats 13 "x times" is designated below as "grinding cycle".

The lifting elements 28 can press the flats 13 at each end thereof against a stop face 70 of a stop element 71. The stop face 70 is disposed at a predetermined distance from the grinding elements 42. These stop faces determine the immersion depth of the grinding elements 42 into the clothing 14. Since the height of the clothing decreases with each grinding process and the immersion depth requires a certain depth for optimal grinding, it is advisable to provide the stop face 70 with an adjustable arrangement with respect to the grinding elements 42. In a clothing 14 which has already been ground several times the distance of the stop face 70 from the grinding elements 42 is lower than in new clothings 14. The lifting elements 28 press the flat 13 only as hard against the stop face 70 so that a clamping effect is achieved which is so low that a further movement of the flats 13 beyond the lifting elements 28 is possible.

The grinding can be performed without switching off the carding machine. For this purpose it is advantageous that the grinding device works on cleaned flats 13, meaning that the grinding device is disposed downstream of the flat cleaning. It has also proven to be advantageous to remove the particles released by the grinding from the flat zone, as they could otherwise settle on the running surfaces of the flats 13 (on the "lap bend" of the carding machine). The removal of the waste material is produced by an air stream L which is produced by a negative pressure in the air suction conduit 23 and preferably flows from one side to the other of the flat grinding position. For this purpose the housing 20 is provided with a suitable air supply opening 33. A screen wall 34 extends from the air suction conduit 23 practically up to the flat grinding place, or at least as close as possible to the same, without risking any stripping contact of the grinding bristles with the isolated edge 35 of the screen wall 34.

Once the clothing tips have been ground, the device is switched off again in such a way that the power supply to the lifting apparatus 26 and the brush drive 22 is cut off and the suction conduit 23 is separated from the main suction device 25 again by the flap (not shown). The flats 13 will accordingly only move along the normal path of the flats and they are no longer advanced to the grinding brush. After an operational interval without grinding the flats the grinding device can be put back into operation in order to keep the quality of the carding work in the main carding zone at the desired level.

Once a number of grinding cycles have been processed the grinding bristles 42 will be shorter than their original length due to wear and tear. Although the bristles 42 per se are still useful, the required minimum immersion depth ET (as long as the advancement of the flats remains the same) can no longer be reached. This problem could be solved in principle in such a way that the housing 20 is adjustable with respect to the card frame. In an alternative the advancing movement is changed in order to compensate the shortening of the bristles 42. This can be achieved in such a way that a stop (not shown) is provided in order to determine the (lifted) positions of the lifting elements 28 during the advancement of the flats 13, with the position of the stop towards the brush being changeable. The pneumatic lifting apparatus 26 needs to be designed in such a way that it can lift the lifting elements 28 up to a predetermined "limit position" of the stop. Once this position is reached, the shortening of the grinding bristles 42 has progressed to such an extent that they preferably should be replaced instead of being further used.

The grinding device can be actuated manually in the sense that it can be put into or out of operation by hand, e.g. by start/stop buttons on a control panel which is assigned directly to the device. An operator can thus decide when and how long the device is put into operation. In a more efficient variant the device is controlled in a purposeful manner, however, preferably by the card control unit, e.g. according to an assignment concept which is generally described in EP-B-565 486. In a preferred embodiment the flat clothings are ground after processing a predetermined quantity of fiber material (e.g. metric tons), with the predetermined quantity being variable depending on the type of fiber.

Figure 10:
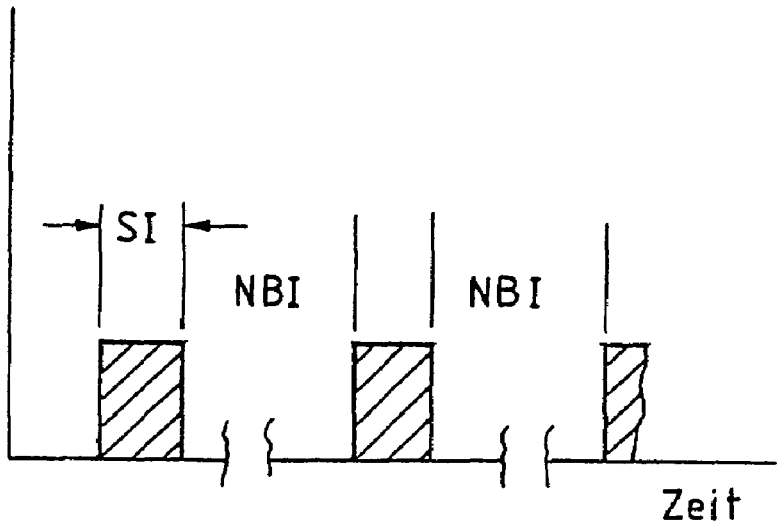
FIG. 10 a time diagram to explain the diagram according to FIG. 9.

Preferably, a "working program" for the lifting apparatus is obtained, as is schematically shown in FIG. 10. Accordingly, there is a normal operation interval NBI, followed by a grinding interval SI, which is again following by a normal operation interval NBI. During the normal operation interval the grinding device is not in use. It is only powered during the grinding interval, i.e. a grinding cycle must be performed during a grinding interval.

The diagram in FIG. 10 is unable to realistically illustrate the time conditions, which is why the "interruptions" in the normal operation intervals are indicated. A normal operation interval NBI will usually be much longer than a grinding interval SI. If for example it is assumed for the sake of simplicity that a set of flats comprises one hundred flats which are moved with a speed of approx. 250 mm/min along the path of the flats and the flat division is approx. 40 mm, a grinding interval or grinding cycle would take approx. 4000/250 minutes=approx. 16 minutes. In this interval or cycle, the clothing of each flat bar is ground once.

The grinding interval can be controlled according to time, meaning that the lifting apparatus 26 can be actuated for a predetermined period of time in order to keep the lifting elements 28 in their working positions, whereafter they can be lowered to their standby position again. In a preferred variant a flat sensor (not shown) is provided at the grinding position which counts the flats 13 as they pass, so that the lifting elements 28 will remain in their working position until all flats have passed the grinding position once (or x times).

The description of the present invention up until now assumes that the device is built into the carding machine, which is not relevant for the invention, however. The grinding device could be designed as a service device which is attached during the grinding to a specific carding machine and thereafter is transferred to another carding machine. Such a device should also be provided with a suction means, which doesn't necessarily need to be connected to the main suction device of the carding machine because types of carding machines can differ considerably and the device should be applicable as "universally" as possible. A "portable" device could also be connected with its own negative pressure source to thus remove the grinding dust.

A portable device could comprise a flat advancement or flat lifting apparatus. This is not mandatory for such a device, however, Firstly, it is common practice of card producers to provide and even install flat lifting apparatus in order to enable the grinding of the flats with a conventional grinding roller and, secondly, it is more easily possible to determine the immersion depth by adjusting the fixing device when attaching a portable device, meaning that it is not necessary to advance the flats at all towards the brush.

It will also be obvious that a portable device is more suitable for manual operation, although time control units or flat counters could easily be used for controlling the grinding process.

A portable device could be designed for application while the carding machine is still running. It will usually be used, however, for use in idle carding machines. In the later case it is not mandatory to attach the grinding device in a specific relationship to the flat cleaning means, because the flats are cleaned in any case during a "service", independent of the cleaning apparatus of the carding machine.

The maximum immersion depth ET of approx. 2 mm can be reduced to approx. 1 mm before changing the advancing movement. Preferably, it does not fall below an immersion depth of 1.5 mm. The change of the advancing movement (i.e. in the given example the change of the position of the adjustable stop) is preferably also controlled, which in principle could also be arranged manually.

The grinding and sharpening method can be performed without coolant (dry sharpening), namely for flexible, semi-rigid and all-steel flat clothings. The sharpening bristle length can be 15 to 20 mm in the first application. The granulation of the bristle can be between approx. 300 and 600, e.g. approx. 500. The flap (not shown), which separates the air suction conduit 23 from the main suction device, can be actuated by the actuating system for the flat advancement (the lifting apparatus 26).

A suitable screen for the running surfaces (the sliding bend) of the flats can be provided in order to prevent any settlement of grinding dust thereon. Such cover plates are not shown here because suitable elements for use with conventional grinding rollers are known and can be used for application in combination with the new device.

The aggressiveness of the grinding elements or the grinding device may need to be increased for working an all-steel clothing, which makes the "fully equipped" carrier more interesting. Since the "side grinding" is without relevance for the all-steel clothing, the elements can be changed so that they mainly act on the (radially outwardly facing) face sides of the clothing teeth. For this purpose the elasticity and the arrangement (e.g. the width) of the grinding elements can be changed in such a way that they have a lower tendency to penetrate between the clothing elements, but an increased ability to bend in the direction of movement of the clothing elements. Instead of grinding bristles it would also be possible to use lamellae for example, which "rest" on the face sides of the clothing teeth. Such a grinding device could also be used for grinding drum, licker-in or doffer clothings. Accordingly, a grinding device can be provided which is provided with elastically bendable grinding elements, with said elements brushing over the face sides of clothing elements and thus being able to grind or sharpen the same.

Figures 11A, 11B:
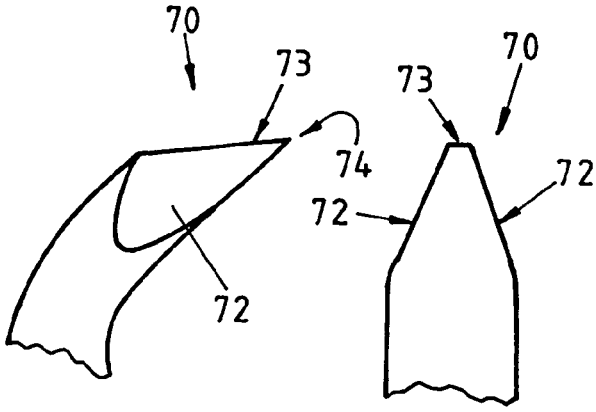
FIGS. 11A to 11D show four schematic representations of end sections of clothing hooks.

The hooks of FIGS. 11A and 11B are new and are each provided with a free end section 70. Each is provided with two side surfaces 72 which are produced by lateral grinding and which jointly form a straight edge 73 which "at the front" produces a sharp tip 74.

Figures 11C, 11D:
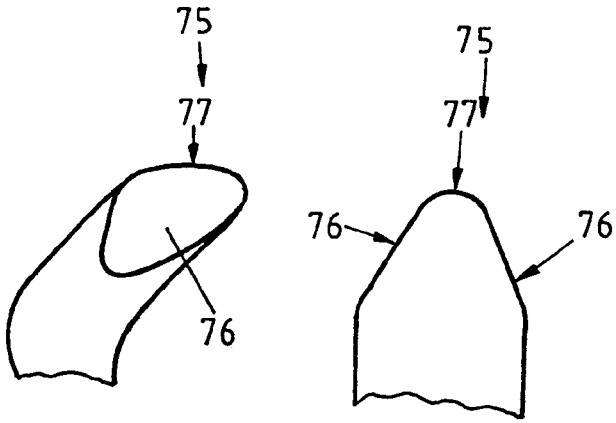

The hooks of FIGS. 11C and 11D are worn off and have been ground by a device according to EP-A-800 895. They are provided with end sections 75 which differ clearly from the end sections 70. Although the grinding device has produced new side surfaces 76 which lead to a final edge 77, said edge 77 is not straight but curved in the side view (FIG. 11C) and, when seen from the front (FIG. 11D) it is slender but rather rounded off instead of sharpened. A tip 74 (FIG. 11A) is missing in any case. It is necessary to achieve the shapes of the end sections according to FIGS. 11A and 11B to the highest possible extent again.

Figure 12:
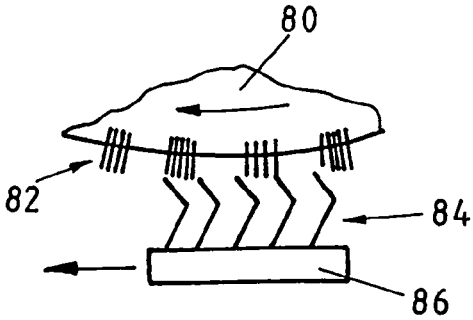
FIG. 12 show a schematic representation of a working principle to solve a problem illustrated in FIGS. 11A to 11D.

A solution is shown schematically in FIG. 12. A rotatable carrier 80 is equipped with grinding bristles 82 which brush over the free ends of hooks 84 of a flat bar 86. The direction of rotation of the carrier 80 and the direction of movement of the rod 86 are indicated with arrows. When the bristles 82 are brought into contact with the ends of the hooks without substantially penetrating in between, they eliminate the curvature of the edge 77 (FIG. 11C) and produce a straight edge again. For this purpose it is necessary to apply a certain pressing pressure, with bristles 82 having to be chosen in such way that they do not penetrate between the hooks under pressure, but work the "face sides" of the hooks.

The grinding bristles 82 therefore preferably differ from the grinding elements 42 of FIG. 2 in such a way that they are shorter, stiffer and thicker or are provided with a denser arrangement for example, as a result of which more bristles are simultaneously in contact with the clothing. For these or other reasons they have a lower elasticity as compared to the elements 42. The carrier 80 is preferably also provided with such a dense arrangement of bristles 82 that the "brush" produced therefrom produces a certain resistance against the penetration of the individual bristles into the clothing, which is why the face sides rather than the side surfaces of the hooks are worked.

A practical solution could therefore comprises two different grinding brushes, whereof one (according to EP-A-800 895) produces the lateral grinding and the other (according to the present invention) produces a sharp tip. The preferred solution comprises only a single "brush" however, which is equipped with two different types of brushes.

Figure 13A:
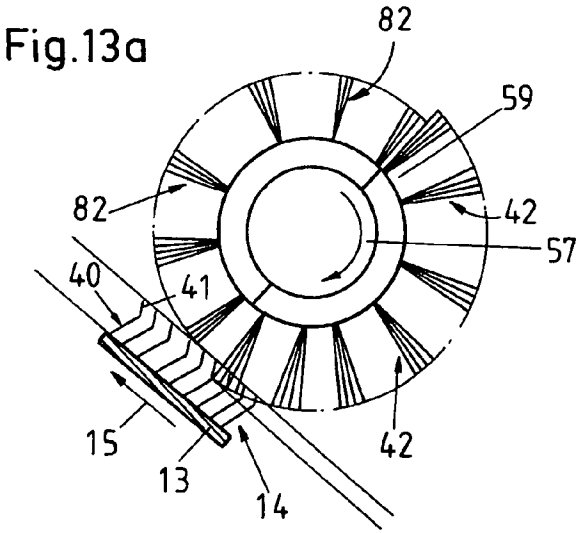
FIG. 13 shows an embodiment of the present invention which is formed as a modification of the device according to FIG. 2.

A first embodiment can therefore be derived directly from the variant according to FIG. 2 by using two different half shells, each with its own type of bristle. Such an embodiment is shown in FIG. 13A. Since the grinding brush does not need to fulfill any cleaning function, the bristles 50 (FIG. 2) are missing which penetrate the base of the flat bar clothing. One half shell is provided with grinding bristles 42 which (as in the variant according to FIG. 2) work the side surfaces of the ends sections of the hooks. The other half shell is provided with additional grinding bristles 82 which (as in the variant according to FIG. 12) work the face sides of the end section.

Figure 13B:
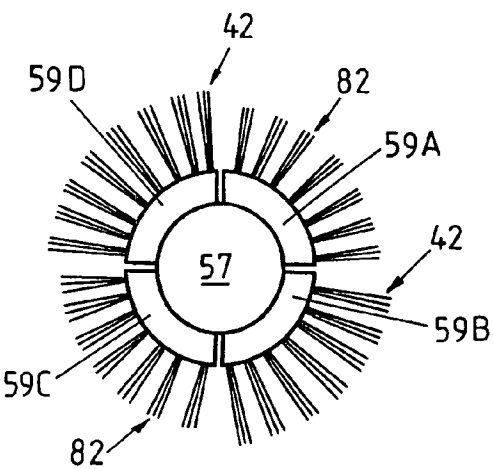

In FIG. 13*b*, four shells 59A, 59B, 59C and 59D are provided which are arranged on a carrier 57. The grinding bristles 42 and 82 are therefore alternatingly arranged on a quarter circle. This allows exchanging only the long bristles or only the short bristles.

The invention is not limited to the variants according to FIGS. 12 and 13. Further variants are shown schematically in the following figures, whereby in said variants each half shell comprises both grinding elements for ensuring the lateral grinding as well as elements for working the face sides of the hooks.

Figure 14:
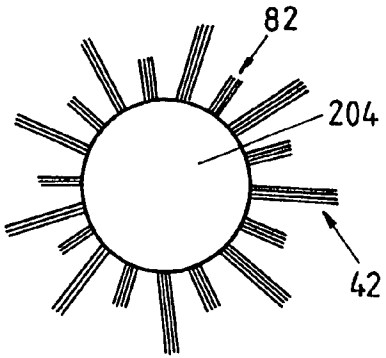
FIG. 14 and FIG. 15 each show a modification of the arrangement according to FIG. 13.

FIG. 14 shows rows of relatively long side grinding elements 42 and rows of relatively short elements 82 for working the face sides. The elements 42 and 82 are inserted alternatingly in each (not shown) half shell. The carrier roller is designated with the reference numeral 204.

Figure 15:
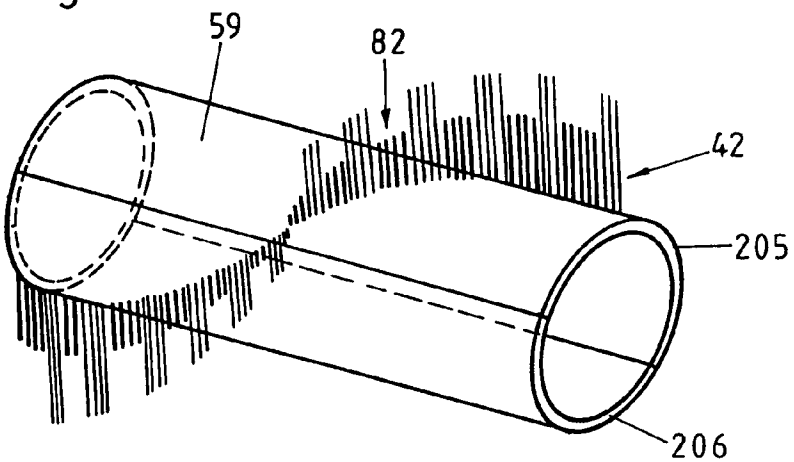

In FIG. 15 each row of bristles is equipped both with long side grinding elements 42 as well as short face side working elements 82. Several of these rows of bristles can be arranged on the carrier roller (not shown). In order to enable easier mounting, they are arranged on half shells 205 and 206 which are screwed on in regular intervals on the cylinder or roller (not shown).

Figure 16:
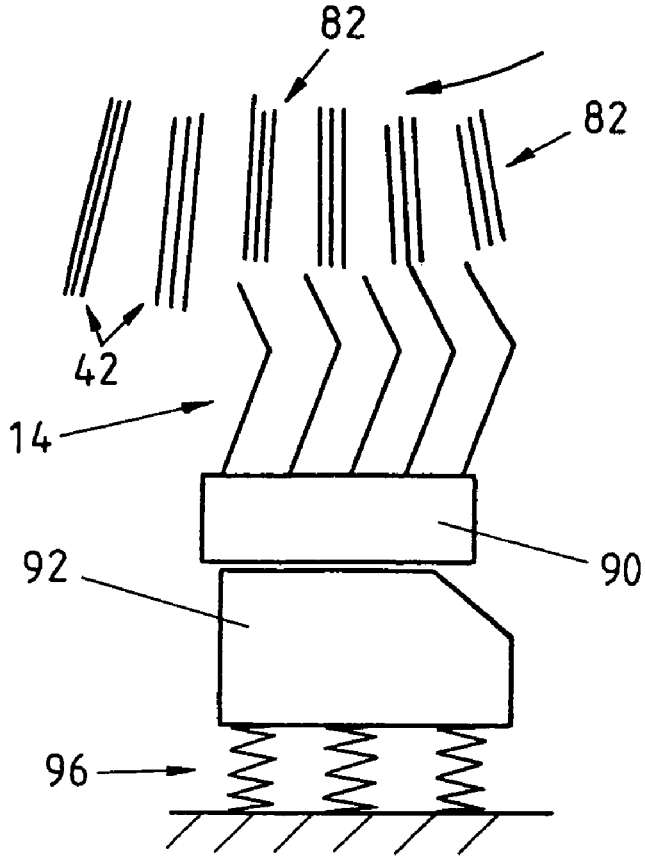
FIG. 16 shows a first possibility to produce the required pressing pressure.
Figure 17:
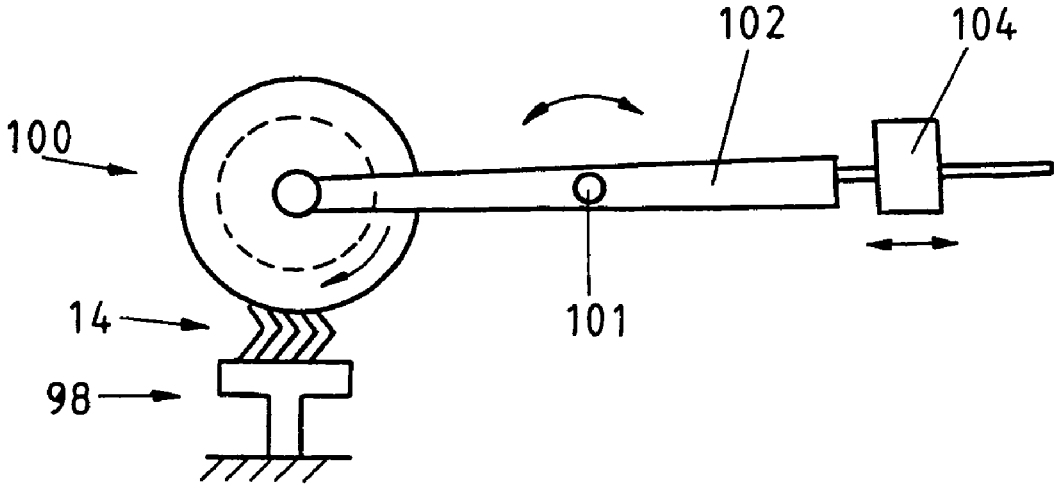
FIG. 17 shows a second possibility for the same purpose.

FIGS. 16 and 17 each show a possibility for producing the required pressing pressure during the sharpening of the clothing. In the variant according to FIG. 16, a flat bar 90 is advanced to the grinding brush by means of an advancing plate 92. The brush is only schematically indicated here by the bristles 82, 42, with the direction of rotation being indicated with an arrow. The plate 92 is pushed by means of a spring 96 in the direction towards the rotational axis (not shown) of the brush, with the advancing movement being limited by the contact of the end sections of the hook with the relatively stiff bristles 82. When the difference in length between the shorter and the longer bristles is approx. 1 to 4 mm (preferably 1.5 to 2.5 mm), the longer bristles 42 penetrate into the clothing 14 in a respective manner and ensure the side grinding.

The stiffer bristles 82 can be ground by means of a trimming device prior to the installation in the carding machine in such a way that the brush extends in the working position transversally over the machine parallel to the flat bar geometry.

In the variant according to FIG. 17, the flat bar 98 is "fixedly" positioned with its clothing 14, meaning that it is not pushed against the schematically indicated sharpening brush 100. Instead, the sharpening brush 100 is pressed against the flat bar 98, e.g. in such way that it is rotatably mounted on a lever 102, with the lever 102 being swivellably held on an axle 101. The pressing pressure exerted by brush 100 on rod 98 is adjustable because a counterweight 104 is provided which is adjustable in the longitudinal direction of lever 102. The counterweight 104 is used to set the force with which the brush 100 and the clothing are pressed against one another.

Figure 18:
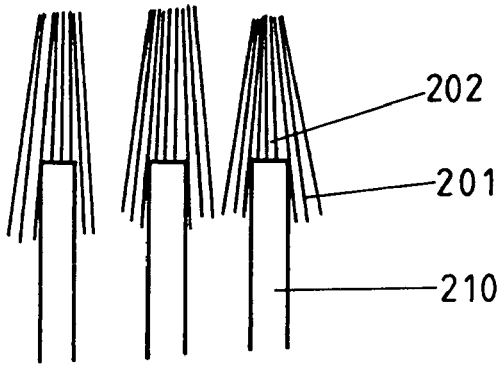
FIG. 18 shows the engagement of side and face grinding elements into a clothing.

FIG. 18 shows the engagement of the flank grinding elements 201 and the face grinding elements 202 with respect to the clothing elements 210. It shows that the face grinding elements 202 are shorter than the flank grinding elements 201. This ensures that the longer flank grinding elements 201 are substantially only in contact with, and grind the side surfaces of, the clothing elements 210. The shorter face grinding elements 202 only reach up to the tip or face of the clothing elements 210. As a result, they only brush along the face side of the clothing elements 210, so that only the face grinding elements 202 work the face side.

Figure 19:
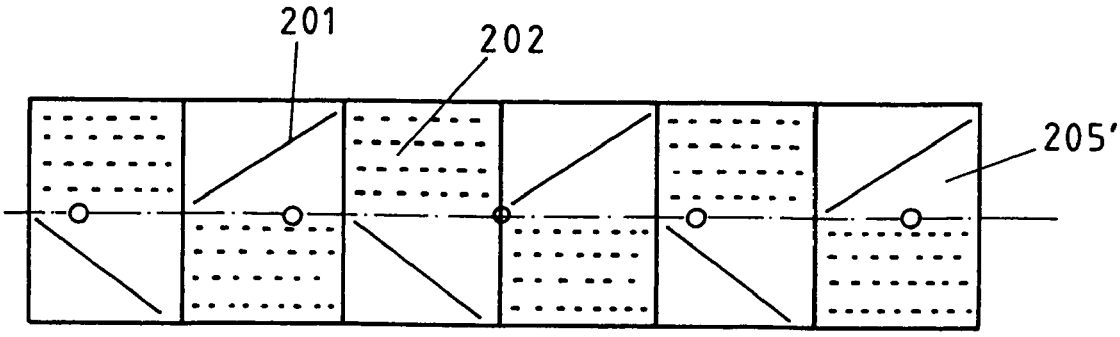
FIG. 19 shows a trimming of a shell.

FIG. 19 shows an example of an arrangement of grinding elements 201 and 202 on a half shell 205. In contrast to the embodiments according to FIGS. 13A and 13B, a different equipment with grinding elements 201 and 202 is shown on a half shell 205. The half-shell 205 is divided into individual segments. Flank grinding elements 201 and face grinding elements 202 are arranged in adjacent segments. As a result, each clothing element 210 is brushed over both by flank grinding elements 201 as well as by face grinding elements 202 during each rotation. To compensate for the axial forces which act on the roller 204 (not shown), it is provided that the flank grinding elements 201 are arranged in opposite directions. The axial forces which could occur due to the inclined arrangement of the flank grinding elements 201, will thus cancel each other out.

The flank grinding elements 201 are arranged in a substantially lower number on the half shell 205 than the face grinding elements. As a result, a relatively strong resistive force is brought to bear against the clothing elements 210 by the face grinding elements 202, so that the immersion depth is determined substantially by the height of the face grinding elements 202.

The segments which comprise the face grinding elements 202 can overlap one another in the circumferential direction of the brushes. This prevents that "passages" between the segments remain open, which would lead to unground clothing needles (in the passages).

Each group of flank grinding elements 201 can consist of two parallel rows of such elements. The "front" row (as seen in the direction of rotation) of each group is worn off first, with the bristles of said front row being supported by the bristles of the rear row. Once the bristles of the front row are shortened by wear and tear, the bristles of the rear row are used.

Figure 20:
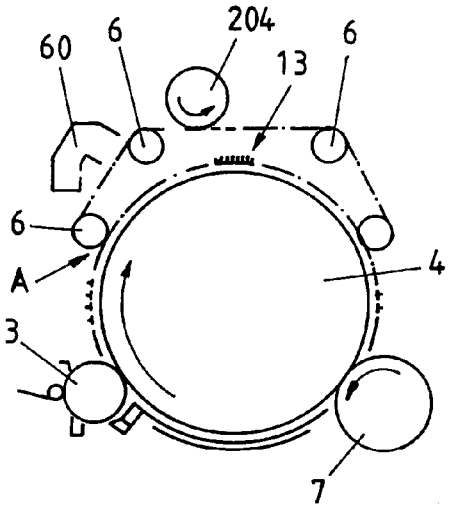
FIG. 20 shows the arrangement of the device in accordance with the invention in a carding machine.

FIG. 20 shows the arrangement of the sharpening and grinding device in accordance with the invention in a carding machine 2 with a revolving flat unit. In this embodiment, the roller 204 is arranged in the running direction of the flat bars 13 downstream of the flat cleaning apparatus 60. This location has proven to be a favorable arrangement of the grinding device both with respect to available space as well as the operational capabilities. The arrangement substantially corresponds to the one of FIG. 1 which also designates the grinding position 62 downstream of the cleaning position 60. The direction of rotation of the roller 204 (or the grinding brush) is opposite of the direction of rotation of the cylinder 4.

Figure 21:
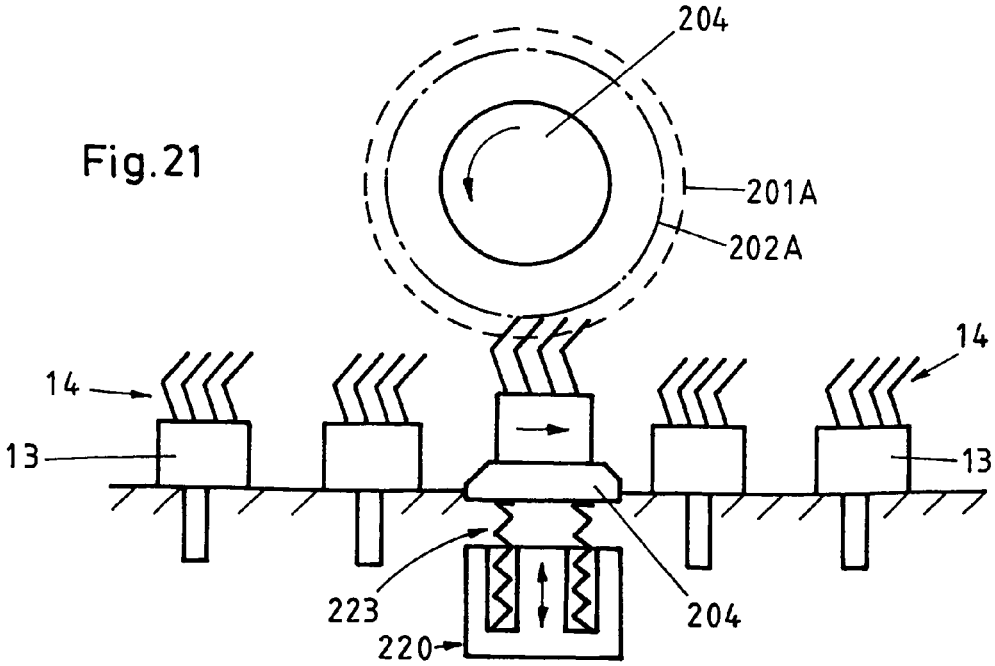
FIG. 21 shows a sketched advancing apparatus in accordance with the invention.

FIG. 21 shows a schematic diagram of the advancing device in accordance with the invention. It shows flat bars 13 with a clothing 14 each which are mutually connected by way of connecting elements (not shown) such as chains or belts. A flat 13 is supplied to an advancing device 220. The flat 13 is moved in this case on a slide block 224 which moves the flat bar 13 in the direction towards a roller 204. The roller 204 rotates in the direction of the arrow with a circumferential speed which allows a sufficient cutting speed for grinding the clothing 14. The flat bar 13 is pressed by means of the spin tension resulting from the springs 223 against the grinding elements which are arranged on the roller 204. The grinding elements are only shown in FIG. 21 with the respective "jacket surfaces" 202A (for the shorter, stiffer elements for grinding the face edges) and 201A (for the longer, more flexible elements for performing the lateral grinding). The grinding elements 201 and 202 produce a respective force against the flat bar 13, so that an equilibrium is obtained between the roller 204 and the flat bar 13. As a result of said equilibrium it is possible to achieve a predetermined penetration depth of the clothing 14 into the grinding elements 201.

If the grinding device is to be prevented from pressing on the clothing 14, the advancing device 220 is moved away from roller 204 in the direction of the double arrow. As a result, the flat bars 13 move past the slide block 224 and are not lifted in the direction towards the roller 204. This concerns a kind of on-off apparatus for the grinding device.

Figure 22:
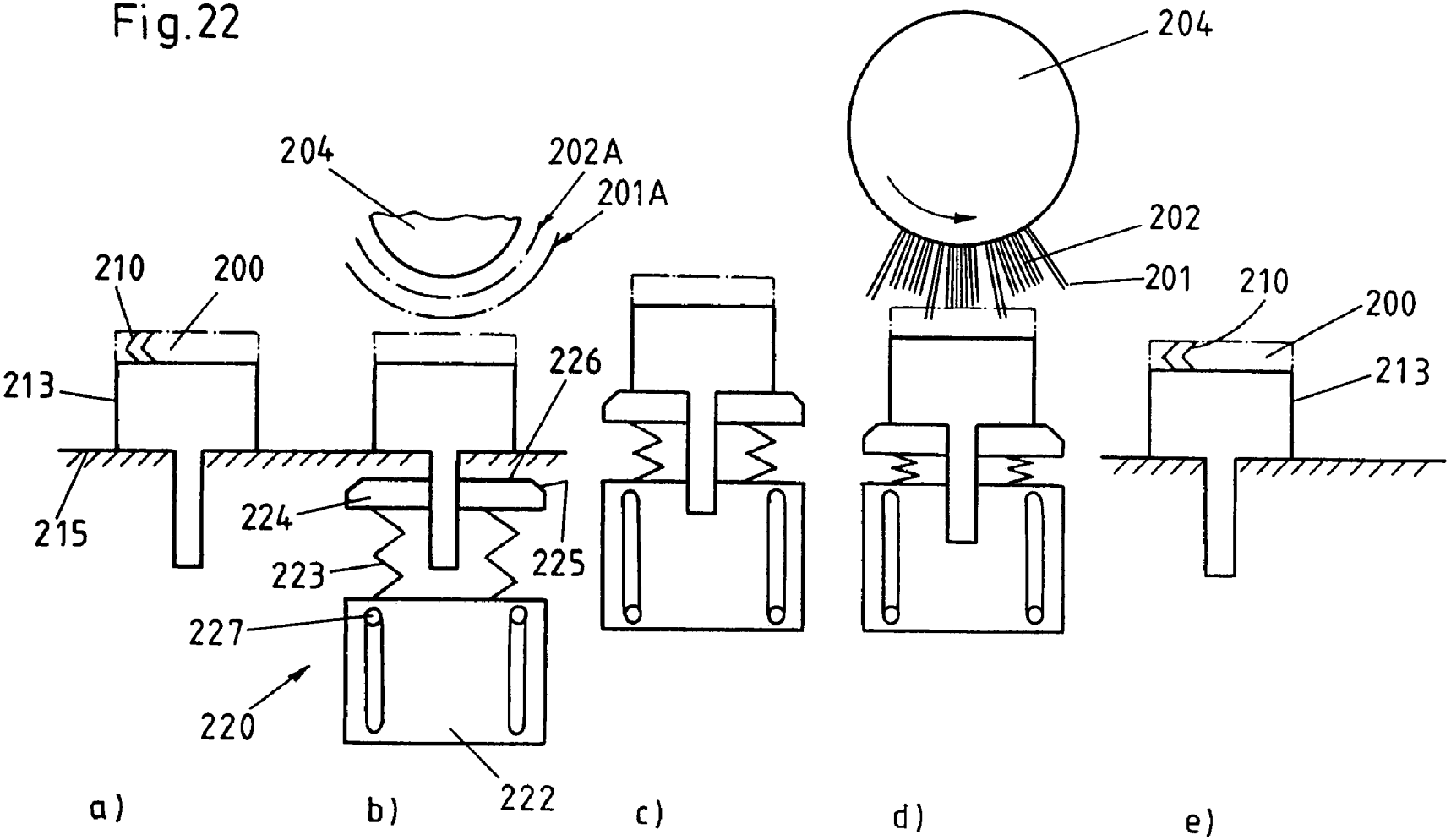
FIG. 22 shows a functional sequence of the advancing apparatus in accordance with the invention.

FIG. 22 shows in the diagrams a) through e) various situations in the zone of the grinding roller 204.

In a), a clothing carrier 213 is shown with a clothing 200. The clothing carrier 213 is a flat bar in this case. The clothing 200 consists of a plurality of clothing elements 210. They can be hooks or, in other embodiments, teeth. The clothing carrier 213 slides on a guide means 215.

b) shows the advancing device 220 when it is in the idle position and the roller 204 with the jacket surfaces 201A, 202A (as in FIG. 21). As a result of the distance of the guide means 215 from the grinding roller 204, the clothing carrier 213, when it slides on the guide means 215 below the roller 204, has no contact with the roller 204 or the grinding elements 201 and 202. The advancing device 220 consists in this shown embodiment of a slider element 222 which can be moved in guide means 227 in the direction towards the roller 204. Springs 223 are arranged on the slider element 222. A slide block 224 is fastened to the springs 223. In the illustrated position of the advancing device the springs 223 are in the pre-tensioned position. Due to the fact that the slider element 222 is located in the lowermost position, the slide block 224 has no contact to the clothing carrier 213 which is moved over the same.

The illustration c) shows how the clothing carrier 213 is located on a supporting surface 226 of the slide block 224. The clothing carrier 213 has been moved before via ramps 225 onto the supporting surface 226. The position c) shows the spring deflection of the springs 223 by the load with the clothing carrier 213. For reasons of illustration, the counterforce which is applied in case of application by the roller 204 has been omitted. The slider element 222 is in the extended position in position c). This means that the guide means 227 are located here in the maximum position of advancement.

In contrast to position c), position d) shows the actual state of the position of the clothing carrier 213 with arranged roller 204. It can be seen that the grinding elements 201 and 202 press against the clothing 200 and the clothing elements 210. The spring tension of springs 223 is counteracted by an external force by the grinding elements 201 and 202. The advancing device is thus situated in an equilibrium, so that on the one hand the force of springs 223 acts against the force of the grinding elements 201 and 202, and the grinding elements 202 in particular, which corresponds to the pressing pressure. The shorter and stiffer face grinding elements 202 substantially exert the resistance against the spring tension.

The system offers the essential advantage that as a result of the spring force and the resistance of the grinding elements 201 and 202 a self-adjustment of the device is performed. Whereas the slider element 222 merely needs to be conveyed from one stop position to the other stop position, the spring tension ensures a permanently even pressure of the clothing elements 210 against the grinding elements 201 and 202. By providing a different pretension of the springs 223 it is also possible to set different forces here, as a result of which the immersion depth of the clothing elements 210 into the grinding elements 201 and 202 can be predetermined.

In position e) the ground clothing carrier 213 is again outside of the engagement of the roller 204 after passing the grinding apparatus and is arranged outside of the engagement of the advancing device 220 on guide means 215.

Figure 24:
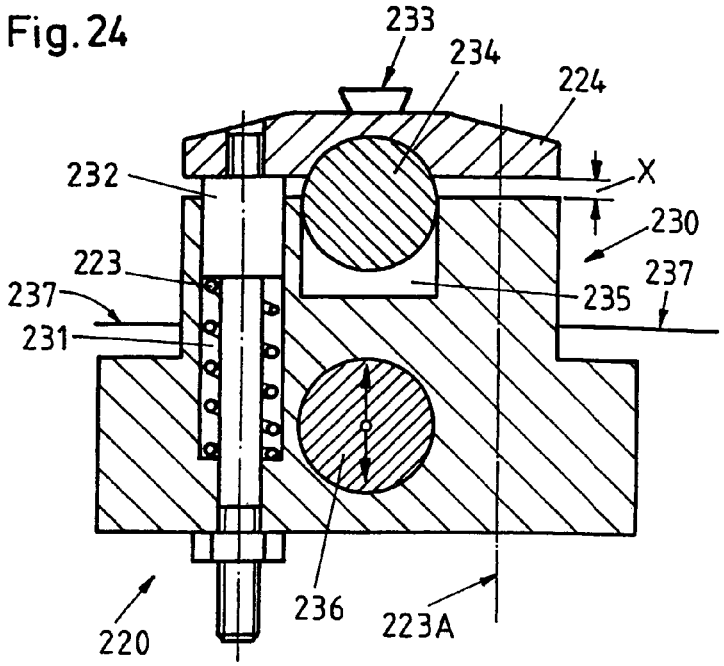
FIG. 24 shows a view on an enlarged scale of a slide block carrier for use in an arrangement according to FIG. 23, and FIG. 25 schematically shows a control unit for use in combination with an arrangement according to FIGS. 23 and 24.

FIG. 24 shows a carrier part 230 of an advancing device with a slide block 224 and springs 223, whereof only one spring is indicated by a dot-dash line 223A. The carrier part 230 has a receiving bore 231 for each spring 223, with a guide member 232 which is connected with the slide block 224 also being received in said bore 231. When a flat sliding element (indicated partly with 233) rests on the slide block 224, the guide members 232 are pressed in their respective bores 231 against the spring tension. The distance "x" between the slide block 224 and the carrier part 230 can be adjustable in order to enable choosing the spring tension.

In its standby position, the slide block 224 is situated in the vicinity of a guide element 234 which is fixedly attached in the frame (not shown) of the grinding apparatus and is received in a pocket hole 235 in the carrier part 230, with the element 234 sliding along the sides of the hole 235 when the carrier part 230 is displaced upwardly.

The carrier part 230 is mounted swivellably on a stub axle 236 of an eccentric shaft (not shown). During the rotation of the eccentric shaft, the axle 236 is vertically rotatable in the directions indicated by the arrows. The element 234 prevents a rotational movement of the part 230. The carrier part 230 can thus be brought into contact with a stop 237. Such carrier parts must naturally be provided on either side of the cylinder 4 (FIG. 20). Every actuating apparatus (eccentric shaft and carrier part 230 in this example) is preferably adjustable in order to ensure that the advancing movements of the carrier parts 230 on the two sides of the carding machine are substantially the same (i.e. the movements from the respective standby to the respective working positions).

It is understood that the present invention is not limited to the illustrated embodiments. It is naturally also possible to provide a different kind of advancing apparatus. Instead of longitudinal guide means as are illustrated in FIG. 22, it is also possible to provide eccentric guide means. Moreover, the advancement of the roller 204 towards a stationary support of the clothing carriers 213 is possible in which the roller 204 is analogously elastically held, like the advancing device in the embodiment of FIG. 22. This would be a kind of combination of the embodiment according to FIG. 22 with the embodiment according to FIG. 17. The trimming of the grinding device can also contain cleaning brushes, as are shown in FIG. 2, in addition to the grinding elements 201 and 202. In addition to the grinding process, a cleaning of the clothing can be performed simultaneously. Moreover, all illustrated embodiments can be combined with one another and with the solutions of the state of the art as explained in detail above.

Figure 23:
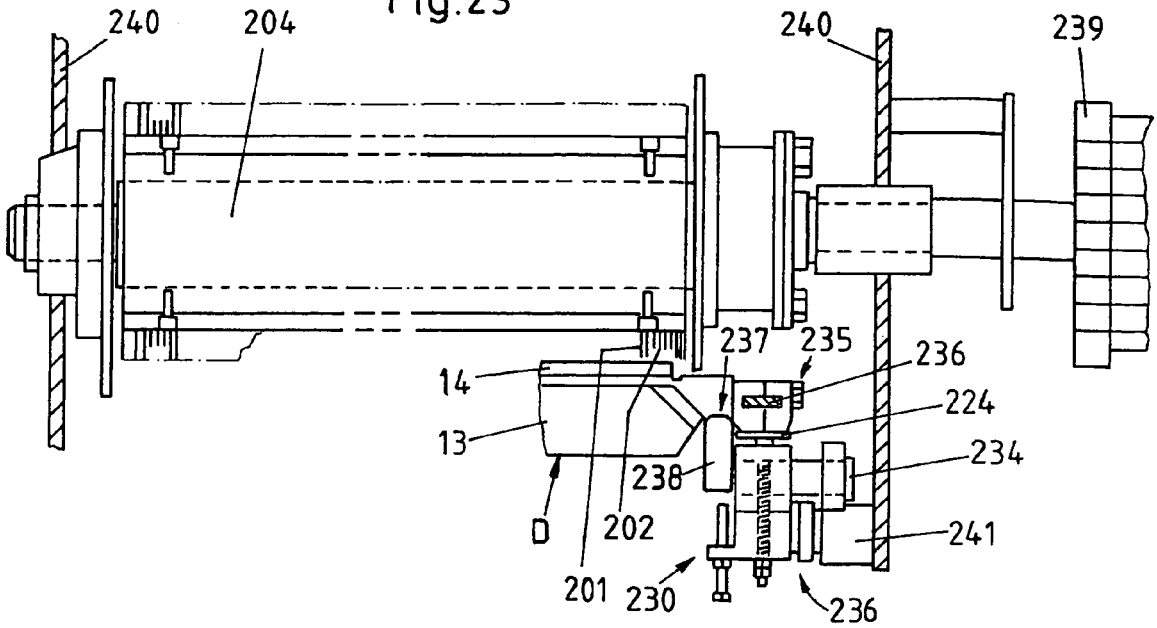
FIG. 23 shows a schematic composition of the individual elements of a grinding device with an end part of a flat.

FIG. 23 schematically shows a composition of a grinding device SV with (only) an end part of a flat D, with the middle portion of the grinding apparatus SV being cut out. The grinding apparatus SV comprises a roller 204, a drive motor 239 with half-shells (not indicated in particular) which are provided with long bristles 201 and short bristles 202 (cf. FIG. 18 to 22). The flat D comprises a flat bar 13 with a clothing 14. The rod 13 is connected at one end with a belt 236 by means of an end head 235. Connections suitable for this purpose are shown in GB-B-870 424, DE-Gbm-7345579 and EP-A-627507 for example. The other end of the flat bar 13 is connected in the same manner with a second belt, which is why only on end needs to be shown and explained. The end head 235 is also provided with a sliding section 237 which usually slides on a so-called return rail 238 while the flat of the grinding apparatus approaches or after the flat has left the grinding apparatus. After the actuation of the advancing apparatus according to FIG. 21, the end head 235 of a flat bar in the grinding position is no longer in contact with the return rail assigned to the same. Instead, an outer part 233 (FIG. 24) of the end head, slides assigned to said rod end on the slide block (or slide plate) 224.

The grinding apparatus is mounted between two side walls 240 which have been fixedly attached to the card frame. Adjusting means (not shown) are provided to ensure that the axle of roller 204 stands parallel to the longitudinal axis of the flat bar 13 when the flat bar 13 rests on the return rails. After the actuation of the grinding or advancing apparatus the longitudinal axis of the lifted flat bar should still stand parallel to the longitudinal axis of the roller 204. The advancing apparatus in FIG. 23 comprises a carrier part 230 (cf. FIG. 24) which cooperates with a guide element 234 and a stub axle 263 (cf. FIG. 24) of an eccentric shaft 273. The shaft 273 per se is mounted rotatably in a bearing 241 fastened in the wall. A tilting lever and a pneumatic cylinder for rotating the eccentric shaft 273 are located outside of the side walls 240. The latter elements have been omitted to enhance the clarity of the representation in FIG. 24. The card control unit initiates the actuation of the pneumatic cylinders in order to actuate the advancing apparatus.

The parameters required for the grinding operation can be entered into the programming of the carding machine. The programming will calculate distributed over the life of the flat clothing the grinding schedule and the number of grinding cycles. The calculated number of grinding cycles depends on the selected speed of the flats. Each of them is ground during 20 minutes for example distributed over their life. Depending on the flat speed, this corresponds to between 63 and 163 grinding cycles. A grinding cycle is started through the programming. The grinding brush starts. The flats are lifted via resiliently held plate of the apparatus by means of pneumatic cylinders. At the same time, the slide valve for the suction off of the dust is opened. The long grinding bristles immerse into the clothing and ensure the lateral grinding. The short bristles touch the clothing and ensure a sharp working edge. The grinding brush remains active only during one circumference of all flats. For this purposes, the initiator of the flat control counts the passing flats. After the cycle is completed, the pneumatic cylinders are relieved, the suction is closed and the motor of the grinding brush is switched off.

This shows that during a grinding cycle each flat clothing is preferably ground at least once, which can usually be ensured by simply counting the passing flats. Problems will only arise in this connection when the counting process is interrupted by a malfunction (e.g. due to a power outage). There are several possibilities for dealing with such malfunctions.

According to a first variant, the ground flats are counted from the beginning of a cycle. In the event of a malfunction, a "decision" is made by the control unit as to whether the entire cycle should be repeated or to whether the (interrupted) partial cycle can in this case be regarded as a complete cycle. Such a decision can be made on the basis of the number of ground flats in relationship to the number of unground flats for example. If within an interrupted cycle in the traveler 80% or more of the flats have been ground, the cycle can be regarded as "finalized" or "completed" (in the event of a malfunction which leads to an interruption). If, on the other hand, (in the event of an interrupted cycle) the number of ground flats corresponds to less than the predetermined percentage rate, this cycle should be repeated in its entirety, meaning that "it should be started from the beginning again", whereby all flats are ground.

According to a second variant means are provided in order to mark at least one position on the movable part of the revolving flat unit, so that the control unit is able by means of a mark recognition device to determine which flats have already been ground during an interrupted cycle. In such a case the cycle can be completed after repairing the malfunction.

In a preferred embodiment which can be used to realize said second variant, the machine is provided with means in order to determine the current "position" of the revolving flat unit in comparison with a predetermined point of reference. The point of reference can be provided with a sensor which responds to flats passing the same and which cooperates with an evaluating unit in order to determine the said position of the unit.

In a conventional revolving flat unit the flats cannot be distinguished from one another, i.e. there is no "preferred position" on the flat or the movable flat conveying means which would mark a beginning, an end or any other place on said means.

For this purpose each flat could be provided for example with a respective marking (e.g. with a "barcode"), so that each flat is recognizable by means of a suitable sensor as an "individual". Such complex arrangements are not necessary however to fulfill this purpose. One would only require a marked flat and a flat counting apparatus. This principle will be explained below by reference to the schematic representation in FIG. 25.

Figure 25:
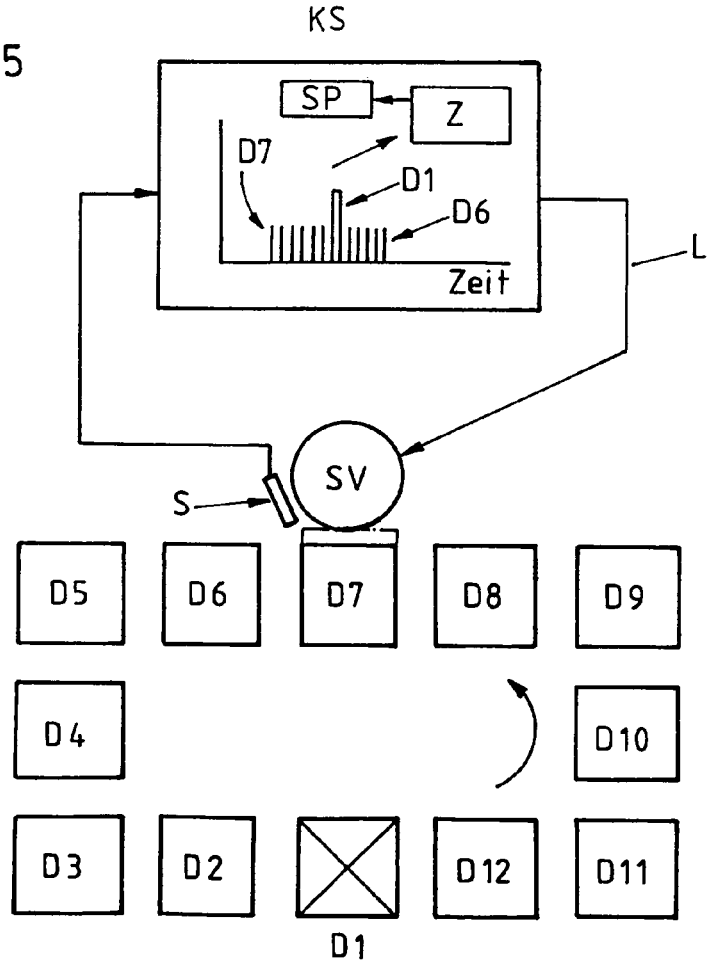

The representation in FIG. 25 is strongly simplified, because the person skilled in the art is capable on the basis of the basic principle to work out a practical solution. Twelve flats D1 to D12 are each shown as a "box". The flats D1 to D12 jointly form with a conveying means (not shown, but well known to the person skilled in the art) a revolving flat unit. Driven by a conveying means said flats move in the direction of the arrow at a predetermined (low) speed. One flat ("D1") is provided with a marking which can be recognized by a sensor S, which is illustrated in FIG. 25 with a cross in box D1. The marking can have any recognizable shape, e.g. a piece of metal which can be scanned magnetically; an additional element that can be scanned by means of a proximity sensor; a color marking that can be scanned optically. Contact-free scanning is preferred, but it is not relevant for the principle.

The sensor S is preferably arranged in the vicinity of the grinding apparatus SV and responds to the flat (D7 in the example) which is momentarily opposite of the apparatus SV, even when the advancing apparatus (FIG. 23) is not activated in order to advance the grinding brush to the passing flats for grinding. The output signal of sensor S is supplied to the card control unit KS and the control unit is in connection with the grinding apparatus SV, which is indicated in FIG. 25 by the line L. The card control unit is provided with a memory (not shown) which contains the data concerning the arrangement of the revolving flat unit, in particular the number of flats in said unit.

It is assumed at first that the carding machine runs up from the standstill. No grinding cycle will take place. The flat conveying means (not shown) drives the flats along their normal path without advancing them to the grinding apparatus SV. This state is shown in FIG. 25 with the unbroken lines. The sensor S responds to every passing flat and produces a respective output signal, e.g. an impulse which is supplied to the card control unit KS. In the example according to FIG. 25, the first impulse is produced by the flat D7 because it moves first past the sensor S. Since "flat D7" is not recognized as such, the control unit cannot (yet) determine the momentary "position" of the revolving flat unit. The flats D8 to D12 then also move past sensor S, with each flat initiating an impulse in the evaluating unit (in the card control unit KS) via the sensor. Since the flats D8 to D12 are also not marked, the impulses cannot be distinguished from one another, which has been illustrated in the "time diagram" of the box KS in FIG. 25 by simple vertical lines.

After a certain delay which depends on the current position of the revolving flat unit in the standstill and the running speed of the flats, the marked flat D1 moves past the sensor S and produces a signal which is clearly distinguished from the signals of the unmarked flats. This is schematically shown in FIG. 25 in such a way that the impulse corresponding to flat D1 is wider and is provided with a larger amplitude, which is not relevant for the principle however, The card control unit KS now "knows" both that the flat D1 is passing sensor S and that the next eleven impulses are to be assigned to the respective flats D2 to D12, although the latter impulses do not differ from one another. By means of a counter Z (indicated schematically within the box KS in FIG. 25), the card control unit KS is therefore able to determine the predetermined "position" of the revolving flat unit with respect to sensor S (as a point of reference).

The representation in FIG. 25 can also be used to explain the control of a grinding cycle, which is why only twelve impulses have been shown in the time diagram.

It can be supposed, that in a grinding cycle, the flat D7 is advanced as the first one by actuating the advancing apparatus (not shown in FIG. 25) of the grinding apparatus SV (broken line), and the grinding apparatus SV per se is put into operation via line L in order to grind the flats one after the other.

Due to the continuous monitoring of the position of the revolving flat unit with respect to sensor S, the card control unit "knows" that this grinding cycle was initiated at flat D7. According to the preferred embodiment the card control unit is programmed in such a way that each flat is ground once during a grinding cycle. The initiated cycle must therefore be continued until flat D6 has been ground, whereupon the grinding apparatus SV is switched off via the line and the advancing apparatus (not shown) should be returned to its standby position. The time diagram in FIG. 24 shows the "signal picture" for such an uninterrupted grinding cycle.

The card control unit KS is provided with memory means SP which memorizes both the first flat of an initiated grinding cycle as well as the "current" (momentarily worked) flat of a cycle—even in the case of a power outage. If for example the cycle as shown in FIG. 25 had to be interrupted after the grinding of only three flats (after the grinding of flat D9, but before the grinding of flat D10), the card control unit KS can resume the grinding again with flat D10 after the renewed start-up of the carding machine and continue it until the end with flat D6, which is performed after the flat recognition system has referenced again, if the memory in the card control unit KS should be unable to store the current position of the revolving flat unit during an interruption.

The invention therefore also provides a revolving flat unit for a revolving flat carding machine, characterized in that means is provided for marking the position of the unit with respect to the provided reference.

A sensor can be provided to recognize the marking and to produce a respective signal. A control unit can also be provided to evaluate the signal and to control a maintenance program accordingly. It can be ensured in this way that all (or only selected) flats are considered (worked) in the maintenance program. It is possible to mark at least one flat, but optionally also several flats. When not all flats are marked, a counter can be provided so as to enable the recognition of the other flats individually. The maintenance program preferably comprises the grinding, but also other maintenance positions such as cleaning for example. The flat recognition system could be linked to a quality testing system for example which would allow the recognition of faults individual flats.

What is claimed is:

1. A device for adjusting the distance between clothing elements provided on a clothing support and a grinding device in a textile machine, said device comprising means for effecting a contact force between said clothing elements and said grinding device so that said grinding device and clothing elements are pressed against each other and a predetermined entering depth of said clothing elements into said grinding device is established; and wherein said grinding device comprises shorter and longer individual grinding elements, said means for effecting a contact force configured so that said shorter grinding elements contact against said clothing elements and said longer grinding elements pass between and alongside said clothing elements.

2. The device as in claim 1, wherein said means for effecting a contact force comprises a movable support surface over which said clothing support is conveyed, said movable support surface configured to press said clothing support against said grinding device.

3. The device as in claim 1, wherein said contact force is a function of resistance of said grinding device to said clothing elements.

4. The device as in claim 1, wherein said contact force is adjustable.

5. The device as in claim 4, wherein said contact force is adjusted such that a balanced force is achieved at said predetermined entering depth.

6. The device as in claim 2, wherein said means for effecting a contact force comprises at least one spring disposed to bias said movable support towards said grinding device.

7. A device for adiusting the distance between clothing elements provided on a clothing support and a grinding device in a textile machine, said device comprising means for effecting a contact force between said clothing elements and said grinding device so that said grinding device and clothing elements are pressed against each other and a predetermined entering depth of said clothing elements into said grinding device is established;

wherein said means for effecting a contact force comprises a movable support surface over which said clothing support is conveyed, said movable support surface configured to press said clothing support against said grinding device; and wherein said means for effecting a contact force comprises at least one hydraulic cylinder disposed to exert a force on said movable support.

8. The device as in claim 2, wherein said movable support surface is movable from a position wherein it is operably disengaged from said clothing support to a position wherein it contacts and changes the traveling course of said clothing support.

9. The device as in claim 2, wherein said movable support surface comprises at least one ramped surface disposed to guide said clothing support up onto said movable support surface.

* * * * *